US009309874B2

(12) United States Patent
Yamamoto et al.

(10) Patent No.: US 9,309,874 B2
(45) **Date of Patent: *Apr. 12, 2016**

(54) SWASH PLATE TYPE VARIABLE DISPLACEMENT COMPRESSOR

(71) Applicant: KABUSHIKI KAISHA TOYOTA JIDOSHOKKI, Aichi-ken (JP)

(72) Inventors: Shinya Yamamoto, Kariya (JP); Takahiro Suzuki, Kariya (JP); Kazunari Honda, Kariya (JP); Kei Nishii, Kariya (JP); Yusuke Yamazaki, Kariya (JP); Masaki Ota, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 250 days.

This patent is subject to a terminal disclaimer.

(21) Appl. No.: 14/064,733

(22) Filed: Oct. 28, 2013

(65) Prior Publication Data

US 2014/0127044 A1 May 8, 2014

(30) Foreign Application Priority Data

Nov. 5, 2012 (JP) ..... 2012-243985

(51) Int. Cl.
*F04B 27/10* (2006.01)
*F04B 27/16* (2006.01)
*F04B 27/18* (2006.01)

(52) U.S. Cl.
CPC ..... *F04B 27/1063* (2013.01); *F04B 27/1054* (2013.01); *F04B 27/1072* (2013.01); *F04B 27/1804* (2013.01); *F04B 2027/1813* (2013.01)

(58) Field of Classification Search
CPC ..... F04B 27/10; F04B 27/12; F04B 27/14; F04B 27/16; F04B 27/18; F04B 27/1054; F04B 27/1804; F04B 2027/1813; F04B 2027/1822; F04B 2027/1831
USPC ..... 417/222.1, 222.2, 269, 270
See application file for complete search history.

(56) References Cited

U.S. PATENT DOCUMENTS 3,062,020 A 11/1962 Heidorn
4,037,993 A 7/1977 Roberts (Continued)

FOREIGN PATENT DOCUMENTS

CN 1075778 9/1993
CN 1225422 8/1999

(Continued)

OTHER PUBLICATIONS

International Preliminary Report on Patentability for PCT/JP2013/079679, mailed May 5, 2015.

(Continued)

*Primary Examiner* — Peter J Bertheaud
(74) *Attorney, Agent, or Firm* — Greenblum & Bernstein, P.L.C.

(57) ABSTRACT

In a compressor according to the present invention, an actuator is arranged in a swash plate chamber in a manner rotatable integrally with a drive shaft. The actuator includes a rotation body, a movable body, and a control pressure chamber. A control mechanism includes a bleed passage, a supply passage, and a control valve. The control mechanism is capable of changing the pressure in the control pressure chamber to move the movable body. The movable body opposes the lug arm with a swash plate arranged between the movable body and the lug arm.

14 Claims, 6 Drawing Sheets

(56) References Cited

U.S. PATENT DOCUMENTS

| | | | | | |
|---|---|---|---|---|---|
| 4,061,443 | A * | 12/1977 | Black | F04B 27/1072 184/6.17 |
| 4,174,191 | A * | 11/1979 | Roberts | F04B 27/18 417/222.1 |
| 4,886,423 | A | 12/1989 | Iwanami et al. | |
| 4,932,843 | A | 6/1990 | Itoigawa et al. | |
| 4,963,074 | A * | 10/1990 | Sanuki | F04B 27/18 417/222.1 |
| 5,002,466 | A | 3/1991 | Inagaki et al. | |
| 5,022,826 | A * | 6/1991 | Matsuda | F04B 27/12 417/222.1 |
| 5,032,060 | A * | 7/1991 | Kobayashi | F04B 27/12 417/222.1 |
| 5,259,736 | A * | 11/1993 | Terauchi | F01B 3/106 417/222.1 |
| 5,370,503 | A * | 12/1994 | Terauchi | F04B 27/1072 417/222.2 |
| 5,547,346 | A * | 8/1996 | Kanzaki | F04B 49/022 417/222.2 |
| 5,882,180 | A | 3/1999 | Kawaguchi et al. | |
| 6,142,745 | A * | 11/2000 | Kawaguchi | F04B 27/1804 417/222.2 |
| 6,164,929 | A | 12/2000 | Kazuya et al. | |
| 6,217,293 | B1 * | 4/2001 | Murase | F04B 27/1804 417/222.2 |
| 6,517,321 | B1 * | 2/2003 | Takenaka | F04B 27/0895 417/222.1 |
| 6,742,439 | B2 | 6/2004 | Matsuda et al. | |
| 2002/0073722 | A1 | 6/2002 | Ota et al. | |
| 2002/0127116 | A1 | 9/2002 | Koelzer et al. | |
| 2006/0120882 | A1 | 6/2006 | Jordan et al. | |
| 2008/0145239 | A1 | 6/2008 | Murase et al. | |
| 2009/0064855 | A1 | 3/2009 | Kayukawa | |
| 2012/0073430 | A1 | 3/2012 | Uchikado | |
| 2012/0251344 | A1 | 10/2012 | Kobayashi et al. | |
| 2014/0127042 | A1 * | 5/2014 | Yamamoto | F04B 27/1054 417/222.1 |
| 2014/0127045 | A1 | 5/2014 | Yamamoto et al. | |

FOREIGN PATENT DOCUMENTS

| | | |
|---|---|---|
| CN | 1461384 | 12/2003 |
| CN | 2787875 | 6/2006 |
| CN | 101387278 | 3/2009 |
| DE | 10 2009 006 909 | 8/2010 |
| EP | 1 906 017 | 4/2008 |
| EP | 1 933 031 | 6/2008 |
| JP | 52-131204 | 11/1977 |
| JP | 53-69911 | 6/1978 |
| JP | 58-162780 | 9/1983 |
| JP | 62-225782 | 10/1987 |
| JP | 64-41680 | 2/1989 |
| JP | 1-147171 | 6/1989 |
| JP | 2-16374 | 1/1990 |
| JP | 2-19665 | 1/1990 |
| JP | 2-132876 | 11/1990 |
| JP | 3-10082 | 1/1991 |
| JP | 3-134268 | 6/1991 |
| JP | 4-54287 | 2/1992 |
| JP | 5-18355 | 1/1993 |
| JP | 5-172052 | 7/1993 |
| JP | 5-312144 | 11/1993 |
| JP | 2002-21722 | 1/2002 |
| JP | 2002-349431 | 12/2002 |
| JP | 2003-206856 | 7/2003 |
| JP | 2004-60473 | 2/2004 |
| JP | 2007-239722 | 9/2007 |
| JP | 2010-281289 | 12/2010 |
| JP | 2011-27013 | 2/2011 |
| KR | 2010-0013736 | 2/2010 |
| WO | 2006/023923 | 3/2006 |

OTHER PUBLICATIONS

U.S. Appl. No. 14/439,498, filed Apr. 29, 2015 to Hiroyuki Nakaima et al.

U.S. Appl. No. 14/064,632 to Shinya Yamamoto et al., filed Oct. 28, 2013.

U.S. Appl. No. 14/064,864 to Shinya Yamamoto et al., filed Oct. 28, 2013.

U.S. Appl. No. 14/064,424 to Shinya Yamamoto et al., filed Oct. 28, 2013.

U.S. Appl. No. 14/064,499 to Shinya Yamamoto et al., filed Oct. 28, 2013.

China Official Action and English translation thereof, mail date is Jul. 31, 2015.

China Official Action in Application No. 201310524846.0 and English translation thereof, mail date is Aug. 5, 2015.

China Official Action in Application No. 201310525972.8 and English translation thereof, mail date is Aug. 5, 2015.

China Official Action in Application No. 201310524675.1 and English translation thereof, mail date is Sep. 25, 2015.

U. S. Official Action (Notice of Allowance) received in U.S. Appl. No. 14/064,424, dated Aug. 26, 2015.

U.S. Official Action (Notice of Allowance) received in U.S. Appl. No. 14/064,499, dated Aug. 28, 2015.

U.S. Official Action received in U.S. Appl. No. 14/064,632, dated Sep. 2, 2015.

U.S. Official Action received in U.S. Appl. No. 14/064,864, dated Sep. 4, 2015.

European Search Report received in Application No. 13851030.0, mail date is Nov. 13, 2015.

* cited by examiner

SWASH PLATE TYPE VARIABLE DISPLACEMENT COMPRESSOR

BACKGROUND OF THE INVENTION

The present invention relates to a swash plate type variable displacement compressor.

Japanese Laid-Open Patent Publications No. 5-172052 and No. 52-131204 disclose conventional swash plate type variable displacement type compressors (hereinafter, referred to as compressors). The compressors include a suction chamber, a discharge chamber, a swash plate chamber, and a plurality of cylinder bores, which are formed in a housing. A drive shaft is rotationally supported in the housing. The swash plate chamber accommodates a swash plate, which is rotatable through rotation of the drive shaft. A link mechanism, which allows change of the inclination angle of the swash plate, is arranged between the drive shaft and the swash plate. The inclination angle is defined with respect to a line perpendicular to the rotation axis of the drive shaft. Each of the cylinder bores accommodates a piston in a reciprocal manner and thus forms a compression chamber. A conversion mechanism reciprocates each of the pistons in the associated one of the cylinder bores by the stroke corresponding to the inclination angle of the swash plate through rotation of the swash plate. An actuator is capable of changing the inclination angle of the swash plate and controlled by a control mechanism.

In the compressor described in Japanese Laid-Open Patent Publication No. 5-172052, a pressure regulation chamber is formed in a rear housing member of the housing. A control pressure chamber is formed in a cylinder block, which is also a component of the housing, and communicates with the pressure regulation chamber. The actuator is arranged in the control pressure chamber, while being prevented from rotating integrally with the drive shaft. Specifically, the actuator has a non-rotational movable body that overlaps with a rear end portion of the drive shaft. The inner peripheral surface of the non-rotational movable body rotationally supports the rear end portion of the drive shaft. The non-rotational movable body is movable in the direction of the rotation axis of the drive shaft. The non-rotational movable body is slidable in the control pressure chamber through the outer peripheral surface of the non-rotational movable body and slides in the direction of the rotation axis of the drive shaft. The non-rotational movable body is restricted from sliding about the rotation axis of the drive shaft. A pressing spring, which urges the non-rotational movable body forward, is arranged in the control pressure chamber. The actuator has a movable body, which is joined to the swash plate and movable in the direction of the rotation axis of the drive shaft. A thrust bearing is arranged between the non-rotational movable body and the movable body. A pressure control valve, which changes the pressure in the control pressure chamber, is provided between the pressure regulation chamber and the discharge chamber. Through such change of the pressure in the control pressure chamber, the non-rotational movable body and the movable body are moved along the rotation axis.

The link mechanism has a movable body and a lug arm fixed to the drive shaft. A rear end portion of the lug arm has an elongated hole, which extends in a direction perpendicular to the rotation axis of the drive shaft from the side corresponding to the outer periphery of the drive shaft toward the rotation axis. A pin is received in the elongated hole and supports the swash plate at a position forward to the swash plate such that the swash plate is allowed to pivot about a first pivot axis. A front end portion of the movable body also has an elongated hole, which extends in the direction perpendicular to the rotation axis of the drive shaft from the side corresponding to the outer periphery of the drive shaft toward the rotation axis. A pin is passed through the elongated hole and supports the swash plate at the rear end of the swash plate such that the swash plate is allowed to pivot about a second pivot axis, which is parallel to the first pivot axis.

When a pressure regulation valve of the compressor is controlled to open, communication between the discharge chamber and the pressure regulation chamber is allowed. This raises the pressure in the control pressure chamber compared to the pressure in the swash plate chamber, thus causing the non-rotational movable body and the movable body to proceed. The inclination angle of the swash plate is thus increased and the stroke of each piston is increased correspondingly. This increases the displacement of the compressor per rotation cycle. In contrast, by controlling the pressure regulation valve to close, the communication between the discharge chamber and the pressure regulation chamber is blocked. This lowers the pressure in the control pressure chamber to a level equal to the pressure level in the swash plate chamber, thus causing the non-rotational movable body and the movable body to retreat. The inclination angle of the swash plate is thus decreased and the piston stroke is decreased correspondingly. This decreases the displacement of the compressor per rotation cycle.

In the compressor disclosed in Japanese Laid-Open Patent Publication No. 52-131204, an actuator is arranged in a swash plate chamber in a manner rotatable integrally with a drive shaft. Specifically, the actuator has a rotation body rotating integrally with the drive shaft. The interior of the rotation body accommodates a movable body, which moves in the direction of the rotation axis of the drive shaft and is movable relative to the rotation body. A control pressure chamber, which moves the movable body using the pressure in the control pressure chamber, is formed between the rotation body and the movable body. A communication passage, which communicates with the control pressure chamber, is formed in the drive shaft. A pressure control valve is arranged between the communication passage and a discharge chamber. The pressure control valve changes the pressure in the control pressure chamber to allow the movable body to move in the direction of the rotation axis relative to the rotation body. The rear end of the movable body is held in contact with a hinge ball. The hinge ball is joined to a swash plate to allow the swash plate to pivot. A pressing spring, which urges the hinge ball in such a direction as to increase the inclination angle of the swash plate, is arranged at the rear end of the hinge ball.

A link mechanism includes the hinge ball and a link arranged between the rotation body and the swash plate. A pin perpendicular to the rotation axis of the drive shaft is passed through the front end of the link. Another pin perpendicular to the rotation axis of the drive shaft is inserted through the rear end of the link. The link and the two pins support the swash plate to allow the swash plate to pivot in the housing.

When a pressure regulation valve of the compressor is controlled to open, communication between a discharge chamber and a pressure regulation chamber is allowed. This raises the pressure in the control pressure chamber compared to the pressure in a swash plate chamber, thus causing the movable body to retreat. The inclination angle of the swash plate is thus decreased and the stroke of each piston is decreased correspondingly. This reduces the displacement of the compressor per rotation cycle. In contrast, by controlling the pressure regulation valve to close, the communication between the discharge chamber and the pressure regulation chamber is blocked. This lowers the pressure in the control pressure chamber to a level equal to the pressure level in the swash plate chamber, thus causing the movable body to proceed. The inclination angle of the swash plate is thus increased and the piston stroke is increased correspondingly. This increases the displacement of the compressor per rotation cycle.

However, the compressor described in Japanese Laid-Open Patent Publication No. 5-172052 is elongated as a whole in the axial direction due to the non-rotational movable body of the actuator, which moves in the direction of the rotation axis in the rear end portion of the drive shaft.

Additionally, in this compressor, the non-rotational movable body of the actuator rotationally slides on the inner peripheral surface of the non-rotational movable body. Also, the non-rotational movable body moves in the direction of the rotation axis of the drive shaft on the inner peripheral surface and the outer peripheral surface of the non-rotational movable body. This may cause insufficient lubrication about the non-rotational movable body, thus lowering the sliding performance of the actuator. As a result, the inclination angle of the swash plate may not be changed in a favorable manner, thus hampering desirable displacement control performed by selectively increasing and decreasing the piston stroke. Also, in the compressor, wear may occur in the actuator and the vicinity thereof and thus the durability of the compressor may be lowered.

In the compressor described in Japanese Laid-Open Patent Publication No. 52-131204, the actuator is arranged in the vicinity of the rotation axis of the drive shaft compared to the link of the link mechanism. This limits the radial dimension of the control pressure chamber of the actuator, thus making it difficult for the movable body to urge the swash plate. Additionally, the link mechanism of the compressor may hamper lubricant supply to the actuator and such insufficient lubrication may lower the sliding performance of the actuator. This makes it difficult to change the inclination angle of the swash plate of the compressor in a favorable manner, thus hampering desirable displacement control.

SUMMARY OF THE INVENTION

Accordingly, it is an objective of the present invention to provide a compressor that is compact in size and ensures enhanced durability and improved displacement control.

A swash plate type variable displacement compressor according to the present invention includes a housing in which a suction chamber, a discharge chamber, a swash plate chamber, and a cylinder bore are formed, a drive shaft rotationally supported by the housing, a swash plate rotatable in the swash plate chamber by rotation of the drive shaft, a link mechanism, a piston, a conversion mechanism, an actuator, and a control mechanism. The link mechanism is arranged between the drive shaft and the swash plate, and allows change of an inclination angle of the swash plate with respect to a line perpendicular to the rotation axis of the drive shaft. The piston is reciprocally received in the cylinder bore. The conversion mechanism causes the piston to reciprocate in the cylinder bore by a stroke corresponding to the inclination angle of the swash plate through rotation of the swash plate. The actuator is capable of changing the inclination angle of the swash plate. The control mechanism controls the actuator.

The actuator is arranged in the swash plate chamber and rotates integrally with the drive shaft. The actuator includes a rotation body fixed to the drive shaft, a movable body that is connected to the swash plate and movable relative to the rotation body in the direction of the rotation axis of the drive shaft, and a control pressure chamber that is defined by the rotation body and the movable body and moves the movable body using pressure in the control pressure chamber. The control mechanism changes the pressure in the control pressure chamber to move the movable body. The movable body faces the link mechanism with the swash plate arranged between the movable body and the link mechanism.

In the compressor according to the present invention, the actuator is arranged in the swash plate chamber in a manner rotatable integrally with the drive shaft. The control pressure chamber is formed between the rotation body and the movable body of the actuator at a position around the drive shaft. This configuration decreases the length of the actuator in the direction of the rotation axis. As a result, the axial length of the compressor as a whole is decreased.

Further, in the actuator of the compressor, the rotation body and the movable body rotate integrally with the drive shaft. This decreases insufficient lubrication about the movable body and thus allows the actuator to maintain high sliding performance. As a result, wear does not occur easily in the actuator and the vicinity thereof.

Additionally, the movable body of the compressor faces to the link mechanism with the swash plate located between the movable body and the link mechanism. This increases the radial dimension of the control pressure chamber of the actuator, thus making it easy for the movable body to urge the swash plate. As a result, the inclination angle of the swash plate of the compressor is easily changed and the displacement control by selectively increasing and decreasing the piston stroke is performed in a favorable manner.

As a result, the compressor is compact in size and ensures enhanced durability and improved displacement control.

DETAILED DESCRIPTION OF THE PREFERRED EMBODIMENTS

First to fourth embodiments of the present invention will now be described with reference to the attached drawings. A compressor of each of the first to fourth embodiments forms a part of a refrigeration circuit in a vehicle air conditioner and is mounted in a vehicle.

First Embodiment

Figure 1:
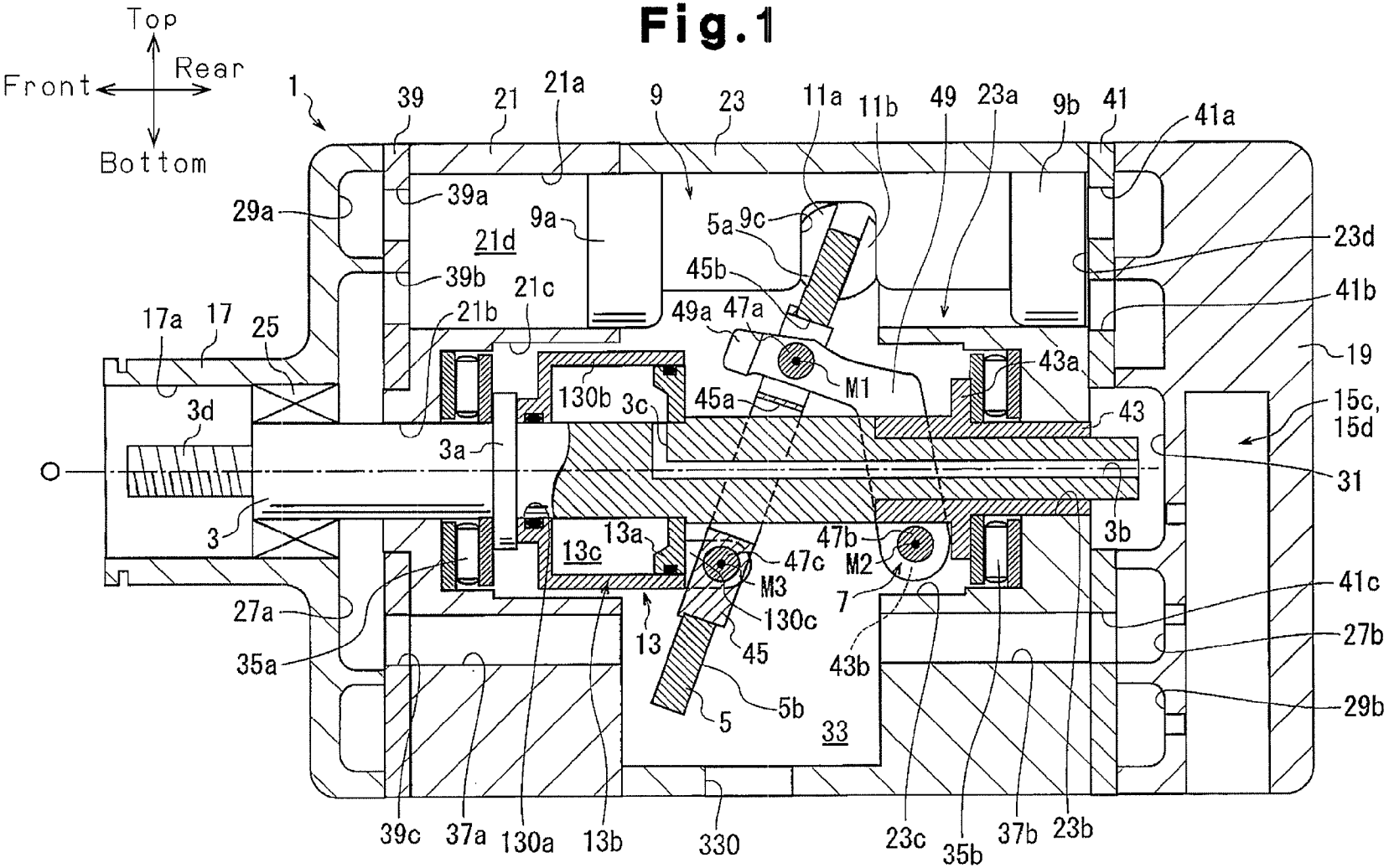
FIG. 1 is a cross-sectional view showing a compressor according to a first embodiment of the present invention in a state corresponding to the maximum displacement.
Figure 2:
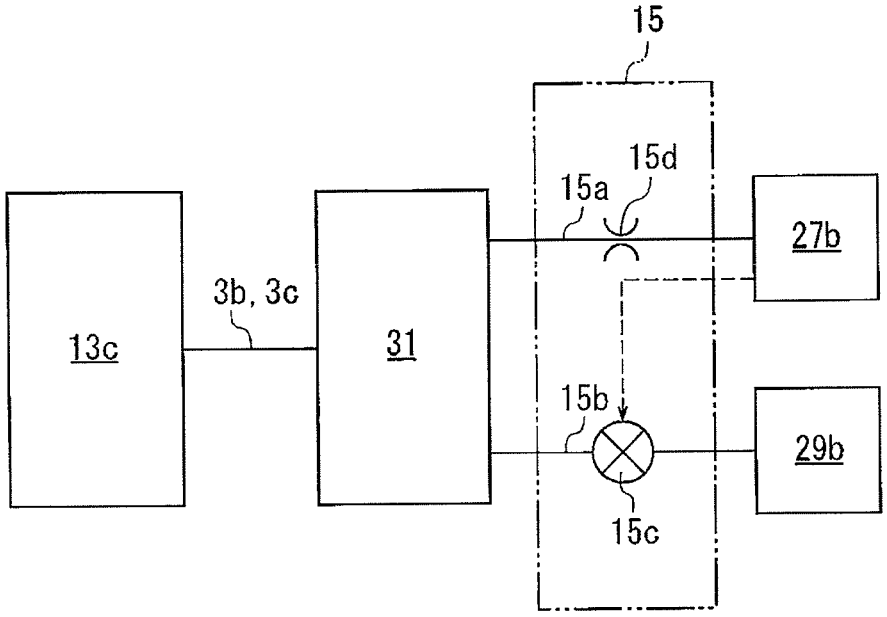
FIG. 2 is a schematic diagram showing a control mechanism of compressors according to first and third embodiments of the invention.
Figure 3:
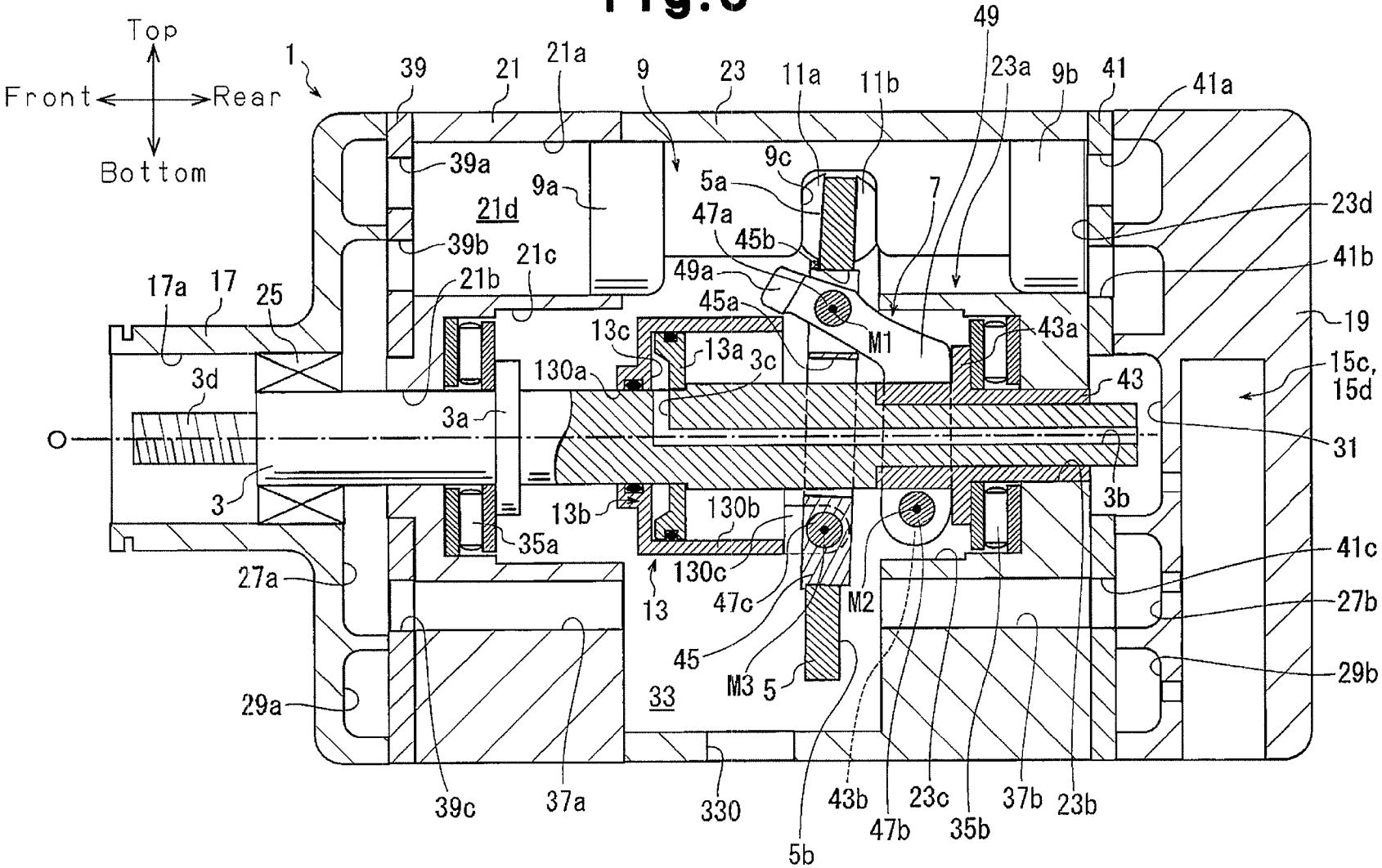
FIG. 3 is a cross-sectional view showing the compressor according to the first embodiment in a state corresponding to the minimum displacement.

As shown in FIGS. 1 and 3, a compressor according to a first embodiment of the invention includes a housing 1, a drive shaft 3, a swash plate 5, a link mechanism 7, a plurality of pistons 9, pairs of front and rear shoes 11*a*, 11*b*, an actuator 13, and a control mechanism 15, which is illustrated in FIG. 2.

With reference to FIG. 1, the housing 1 has a front housing member 17 at a front position in the compressor, a rear housing member 19 at a rear position in the compressor, and a first cylinder block 21 and a second cylinder block 23, which are arranged between the front housing member 17 and the rear housing member 19.

The front housing member 17 has a boss 17*a*, which projects forward. A shaft sealing device 25 is arranged in the boss 17*a* and arranged between the inner periphery of the boss 17*a* and the drive shaft 3. A first suction chamber 27*a* and a first discharge chamber 29*a* are formed in the front housing member 17. The first suction chamber 27*a* is arranged at a radially inner position and the first discharge chamber 29*a* is located at a radially outer position in the front housing member 17.

A control mechanism 15 is received in the rear housing member 19. A second suction chamber 27*b*, a second discharge chamber 29*b*, and a pressure regulation chamber 31 are formed in the rear housing member 19. The second suction chamber 27*b* is arranged at a radially inner position and the second discharge chamber 29*b* is located at a radially outer position in the rear housing member 19. The pressure regulation chamber 31 is formed in the middle of the rear housing member 19. The first discharge chamber 29*a* and the second discharge chamber 29*b* are connected to each other through a non-illustrated discharge passage. The discharge passage has an outlet communicating with the exterior of the compressor.

A swash plate chamber 33 is formed by the first cylinder block 21 and the second cylinder block 23. The swash plate chamber 33 is arranged substantially in the middle of the housing 1.

A plurality of first cylinder bores 21*a* are formed in the first cylinder block 21 to be spaced apart concentrically at equal angular intervals, and extend parallel to one another. The first cylinder block 21 has a first shaft hole 21*b*, through which the drive shaft 3 is passed. A first recess 21*c* is formed in the first cylinder block 21 at a position rearward to the first shaft hole 21*b*. The first recess 21*c* communicates with the first shaft hole 21*b* and is coaxial with the first shaft hole 21*b*. The first recess 21*c* communicates with the swash plate chamber 33. A step is formed in an inner peripheral surface of the first recess 21*c*. A first thrust bearing 35*a* is arranged at a front position in the first recess 21*c*. The first cylinder block 21 also includes a first suction passage 37*a*, through which the swash plate chamber 33 and the first suction chamber 27*a* communicate with each other.

As in the first cylinder block 21, a plurality of second cylinder bores 23*a* are formed in the second cylinder block 23. A second shaft hole 23*b*, through which the drive shaft 3 is inserted, is formed in the second cylinder block 23. The second shaft hole 23*b* communicates with the pressure regulation chamber 31. The second cylinder block 23 has a second recess 23*c*, which is located forward to the second shaft hole 23*b* and communicates with the second shaft hole 23*b*. The second recess 23*c* and the second shaft hole 23*b* are coaxial with each other. The second recess 23*c* communicates with the swash plate chamber 33. A step is formed in an inner peripheral surface of the second recess 23*c*. A second thrust bearing 35*b* is arranged at a rear position in the second recess 23*c*. The second cylinder block 23 also has a second suction passage 37*b*, through which the swash plate chamber 33 communicates with the second suction chamber 27*b*.

The swash plate chamber 33 is connected to a non-illustrated evaporator through an inlet 330, which is formed in the second cylinder block 23.

A first valve plate 39 is arranged between the front housing member 17 and the first cylinder block 21. The first valve plate 39 has suction ports 39*b* and discharge ports 39*a*. The number of the suction ports 39*b* and the number of the discharge ports 39*a* are equal to the number of the first cylinder bores 21*a*. A non-illustrated suction valve mechanism is arranged in each of the suction ports 39*b*. Each one of the first cylinder bores 21*a* communicates with the first suction chamber 27*a* via the corresponding one of the suction ports 39*b*. A non-illustrated discharge valve mechanism is arranged in each of the discharge ports 39*a*. Each one of the first cylinder bores 21*a* communicates with the first discharge chamber 29*a* via the corresponding one of the discharge ports 39*a*. A communication hole 39*c* is formed in the first valve plate 39. The communication hole 39*c* allows communication between the first suction chamber 27*a* and the swash plate chamber 33 through the first suction passage 37*a*.

A second valve plate 41 is arranged between the rear housing member 19 and the second cylinder block 23. Like the first valve plate 39, the second valve plate 41 has suction ports 41*b* and discharge ports 41*a*. The number of the suction ports 41*b* and the number of the discharge ports 41*a* are equal to the number of the second cylinder bores 23*a*. A non-illustrated suction valve mechanism is arranged in each of the suction ports 41*b*. Each one of the second cylinder bores 23*a* communicates with the second suction chamber 27*b* via the corresponding one of the suction ports 41*b*. A non-illustrated discharge valve mechanism is arranged in each of the discharge ports 41*a*. Each one of the second cylinder bores 23*a* communicates with the second discharge chamber 29*b* via the corresponding one of the discharge ports 41*a*. A communication hole 41*c* is formed in the second valve plate 41. The communication hole 41*c* allows communication between the second suction chamber 27*b* and the swash plate chamber 33 through the second suction passage 37*b*.

The first suction chamber 27*a* and the second suction chamber 27*b* communicate with the swash plate chamber 33 via the first suction passage 37*a* and the second suction passage 37*b*, respectively. This substantially equalizes the pressure in the first and second suction chambers 27*a*, 27*b* and the pressure in the swash plate chamber 33. More specifically, the pressure in the swash plate chamber 33 is influenced by blow-by gas and thus slightly higher than the pressure in each of the first and second suction chambers 27*a*, 27*b*. The refrigerant gas sent from the evaporator flows into the swash plate chamber 33 via the inlet 330. As a result, the pressure in the swash plate chamber 33 and the pressure in the first and second suction chambers 27*a*, 27*b* are lower than the pressure in the first and second discharge chambers 29*a*, 29*b*. The swash plate chamber 33 is thus a low pressure chamber.

A swash plate 5, an actuator 13, and a flange 3*a* are attached to the drive shaft 3. The drive shaft 3 is passed rearward through the boss 17*a* and received in the first and second shaft holes 21*b*, 23*b* in the first and second cylinder blocks 21, 23. The front end of the drive shaft 3 is thus located inside the boss 17*a* and the rear end of the drive shaft 3 is arranged inside the pressure regulation chamber 31. The drive shaft 3 is supported by the walls of the first and second shaft holes 21*b*, 23*b* in the housing 1 in a manner rotatable about the rotation axis O. The swash plate 5, the actuator 13, and the flange 3*a* are accommodated in the swash plate chamber 33. A flange 3*a* is arranged between the first thrust bearing 35*a* and the actuator 13, or, more specifically, the first thrust bearing 35*a* and a movable body 13*b*, which will be described below. The flange 3*a* prevents contact between the first thrust bearing 35*a* and the movable body 13*b*. A radial bearing may be employed between the walls of the first and second shaft holes 21*b*, 23*b* and the drive shaft 3.

A support member 43 is mounted around a rear portion of the drive shaft 3 in a pressed manner. The support member 43 has a flange 43*a*, which contacts the second thrust bearing 35*b*, and an attachment portion 43*b*, through which a second pin 47*b* is passed as will be described below. An axial passage 3*b* is formed in the drive shaft 3 and extends from the rear end toward the front end of the drive shaft 3 in the direction of the rotation axis O. A radial passage 3*c* extends radially from the front end of the axial passage 3*b* and has an opening in the outer peripheral surface of the drive shaft 3. The axial passage 3*b* and the radial passage 3*c* are communication passages. The rear end of the axial passage 3*b* has an opening in the pressure regulation chamber 31, which is the low pressure chamber. The radial passage 3*c* has an opening in a control pressure chamber 13*c*, which will be described below.

The swash plate 5 is shaped as a flat annular plate and has a front surface 5*a* and a rear surface 5*b*. The front surface 5*a* of the swash plate 5 in the swash plate chamber 33 faces forward in the compressor. The rear surface 5*b* of the swash plate 5 in the swash plate chamber 33 faces rearward in the compressor. The swash plate 5 is fixed to a ring plate 45. The ring plate 45 is shaped as a flat annular plate and has a through hole 45*a* at the center. By passing the drive shaft 3 through the through hole 45*a*, the swash plate 5 is attached to the drive shaft 3 and thus received in the swash plate chamber 33. The ring plate 45 configures a first member and the support member 43 configures a second member.

The link mechanism 7 has a lug arm 49. The lug arm 49 is arranged rearward to the swash plate 5 in the swash plate chamber 33 and located between the swash plate 5 and the support member 43. The lug arm 49 substantially has an L shape. As illustrated in FIG. 3, the lug arm 49 comes into contact with the flange 43*a* of the support member 43 when the inclination angle of the swash plate 5 with respect to the rotation axis O is minimized. This allows the lug arm 49 to maintain the swash plate 5 at the minimum inclination angle in the compressor. A weight portion 49*a* is formed at the distal end of the lug arm 49. The weight portion 49*a* extends in the circumferential direction of the actuator 13 in correspondence with an approximately half the circumference. The weight portion 49*a* may be shaped in any suitable manner.

The distal end of the lug arm 49 is connected to the ring plate 45 through a first pin 47*a*. This configuration supports the distal end of the lug arm 49 to allow the distal end of the lug arm 49 to pivot about the axis of the first pin 47*a*, which is a first pivot axis M1, relative to the ring plate 45, or, in other words, relative to the swash plate 5. The first pivot axis M1 extends perpendicular to the rotation axis O of the drive shaft 3.

The basal end of the lug arm 49 is connected to the support member 43 through a second pin 47*b*. This configuration supports the basal end of the lug arm 49 to allow the basal end of the lug arm 49 to pivot about the axis of the second pin 47*b*, which is a second pivot axis M2, relative to the support member 43, or, in other words, relative to the drive shaft 3. The second pivot axis M2 extends parallel to the first pivot axis M1. The lug arm 49 and the first and second pins 47*a*, 47*b* correspond to the link mechanism 7 according to the present invention.

In the compressor, the swash plate 5 is allowed to rotate together with the drive shaft 3 by connection between the swash plate 5 and the drive shaft 3 through the link mechanism 7. The inclination angle of the swash plate 5 is changed through pivoting of the opposite ends of the lug arm 49 about the first pivot axis M1 and the second pivot axis M2.

The weight portion 49*a* is provided at the opposite side to the second pivot axis M2 with respect to the distal end of the lug arm 49, or, in other words, with respect to the first pivot axis M1. As a result, when the lug arm 49 is supported by the ring plate 45 through the first pin 47*a*, the weight portion 49*a* passes through a groove 45*b* in the ring plate 45 and reaches a position corresponding to the front surface of the ring plate 45, that is, the front surface 5*a* of the swash plate 5. As a result, the centrifugal force produced by rotation of the drive shaft 3 about the rotation axis O is applied to the weight portion 49*a* at the side corresponding to the front surface 5*a* of the swash plate 5.

Pistons 9 each include a first piston head 9*a* at the front end and a second piston head 9*b* at the rear end. The first piston head 9*a* is reciprocally received in the corresponding first cylinder bore 21*a* and forms a first compression chamber 21*d*. The second piston head 9*b* is reciprocally accommodated in the corresponding second cylinder bore 23*a* and forms a second compression chamber 23*d*. Each of the pistons 9 has a recess 9*c*. Each of the recesses 9*c* accommodates semispherical shoes 11*a*, 11*b*. The shoes 11*a*, 11*b* convert rotation of the swash plate 5 into reciprocation of the pistons 9. The shoes 11*a*, 11*b* correspond to a conversion mechanism according to the present invention. The first and second piston heads 9*a*, 9*b* thus reciprocate in the corresponding first and second cylinder bores 21*a*, 23*a* by the stroke corresponding to the inclination angle of the swash plate 5.

The actuator 13 is accommodated in the swash plate chamber 33 at a position forward to the swash plate 5 and allowed to proceed into the first recess 21*c*. The actuator 13 has a rotation body 13*a* and a movable body 13*b*. The rotation body 13*a* has a disk-like shape and is fixed to the drive shaft 3. This allows the rotation body 13*a* only to rotate with the drive shaft 3. An O ring is attached to the outer periphery of the movable body 13*b*.

The movable body 13*b* is shaped as a cylinder and has a through hole 130*a*, a body portion 130*b*, and an attachment portion 130*c*. The drive shaft 3 is passed through the through hole 130*a*. The body portion 130*b* extends from the front side to the rear side of the movable body 13*b*. The attachment portion 130*c* is formed at the rear end of the body portion 130*b*. The movable body 13*b* is arranged between the first thrust bearing 35*a* and the swash plate 5.

The drive shaft 3 extends into the body portion 130*b* of the movable body 13*b* through the through hole 130*a*. The rotation body 13*a* is received in the body portion 130*b* in a manner that permits the body portion 130*b* to slide with respect to the rotation body 13*a*. This allows the movable body 13*b* to rotate together with the drive shaft 3 and move in the direction of the rotation axis O of the drive shaft 3 in the swash plate chamber 33. The movable body 13*b* faces to the link mechanism 7 with the swash plate 5 arranged between the movable body 13*b* and the link mechanism 7. An O ring is mounted in the through hole 130*a*. The drive shaft 3 thus extends through the actuator 13 and allows the actuator 13 to rotate integrally with the drive shaft 3 about the rotation axis O.

The ring plate 45 is connected to the attachment portion 130*c* of the movable body 13*b* through a third pin 47*c*. In this manner, the ring plate 45, or, in other words, the swash plate 5, is supported by the movable body 13*b* such that the ring plate 45, or the swash plate 5, is allowed to pivot about the third pin 47*c*, which is an operation axis M3. The operation axis M3 extend parallel to the first and second pivot axes M1, M2. The movable body 13*b* is thus held in a state connected to the swash plate 5. The movable body 13*b* comes into contact with the flange 3*a* when the inclination angle of the swash plate 5 is maximized. As a result, in the compressor, the movable body 13*b* is capable of maintaining the swash plate 5 at the maximum inclination angle.

The control pressure chamber 13*c* is formed between the rotation body 13*a* and the movable body 13*b*. The radial passage 3*c* has an opening in the control pressure chamber 13*c*. The control pressure chamber 13*c* communicates with the pressure regulation chamber 31 through the radial passage 3*c* and the axial passage 3*b*.

With reference to FIG. 2, the control mechanism 15 includes a bleed passage 15*a* and a supply passage 15*b* each serving as a control passage, a control valve 15*c*, and an orifice 15*d*.

The bleed passage 15*a* is connected to the pressure regulation chamber 31 and the second suction chamber 27*b*. The pressure regulation chamber 31 communicates with the control pressure chamber 13*c* through the axial passage 3*b* and the radial passage 3*c*. The bleed passage 15*a* thus allows communication between the control pressure chamber 13*c* and the second suction chamber 27*b*. The orifice 15*d* is formed in the bleed passage 15*a* to restrict the amount of the refrigerant gas flowing in the bleed passage 15*a*.

The supply passage 15*b* is connected to the pressure regulation chamber 31 and the second discharge chamber 29*b*. As a result, as in the case of the bleed passage 15*a*, the control pressure chamber 13*c* and the second discharge chamber 29*b* communicate with each other through the supply passage 15*b*, the axial passage 3*b*, and the radial passage 3*c*. In other words, the axial passage 3*b* and the radial passage 3*c* each configure a section in the bleed passage 15*a* and a section in the supply passage 15*b*, each of which serves as the control passage.

The control valve 15*c* is arranged in the supply passage 15*b*. The control valve 15*c* is capable of adjusting the opening degree of the supply passage 15*b* in correspondence with the pressure in the second suction chamber 27*b*. The control valve 15*c* thus adjusts the amount of the refrigerant gas flowing in the supply passage 15*b*. A publicly available valve may be employed as the control valve 15*c*.

A threaded portion 3*d* is formed at the distal end of the drive shaft 3. The drive shaft 3 is connected to one of a non-illustrated pulley and the pulley of a non-illustrated electromagnetic clutch through the threaded portion 3*d*. A non-illustrated belt, which is driven by the engine of the vehicle, is wound around one of the pulley and the pulley of the electromagnetic clutch.

A pipe (not shown) extending to the evaporator is connected to the inlet 330. A pipe extending to a condenser (neither is shown) is connected to the outlet. The compressor, the evaporator, an expansion valve, and the condenser configure the refrigeration circuit in the air conditioner for a vehicle.

In the compressor having the above-described configuration, the drive shaft 3 rotates to rotate the swash plate 5, thus reciprocating the pistons 9 in the corresponding first and second cylinder bores 21*a*, 23*a*. This varies the volume of each first compression chamber 21*d* and the volume of each second compression chamber 23*d* in correspondence with the piston stroke. The refrigerant gas is thus drawn from the evaporator into the swash plate chamber 33 via the inlet 330 and sent into the first and second suction chambers 27*a*, 27*b*. The refrigerant gas is then compressed in the first and second compression chambers 21*d*, 23*d* before being sent into the first and second discharge chambers 29*a*, 29*b*. The refrigerant gas is then sent from the first and second discharge chambers 29*a*, 29*b* into the condenser through the outlet.

In the meantime, rotation members including the swash plate 5, the ring plate 45, the lug arm 49, and the first pin 47*a* receive the centrifugal force acting in such a direction as to decrease the inclination angle of the swash plate 5. Through such change of the inclination angle of the swash plate 5, displacement control is carried out by selectively increasing and decreasing the stroke of each piston 9.

Specifically, in the control mechanism 15, when the control valve 15*c*, which is shown in FIG. 2, reduces the amount of the refrigerant gas flowing in the supply passage 15*b*, the amount of the refrigerant gas flowing from the pressure regulation chamber 31 into the second suction chamber 27*b* through the bleed passage 15*a* is increased. The pressure in the control pressure chamber 13*c* is thus substantially equalized with the pressure in the second suction chamber 27*b*. As a result, as the centrifugal force acting on the rotation members moves the movable body 13*b* rearward, the control pressure chamber 13*c* is reduced in size and thus the inclination angle of the swash plate 5 is decreased.

In other words, as illustrated in FIG. 3, the swash plate 5 pivots about the operation axis M3. The opposite ends of the lug arm 49 pivot about the corresponding first and second pivot axes M1, M2, and the lug arm 49 approaches the flange 43*a* of the support member 43. This decreases the stroke of each piston 9, thus reducing the suction amount and displacement of the compressor per rotation cycle. The inclination angle of the swash plate 5 shown in FIG. 3 corresponds to the minimum inclination angle of the compressor.

The swash plate 5 of the compressor receives the centrifugal force acting on the weight portion 49*a* and thus easily moves in such a direction as to decrease the inclination angle. The movable body 13*b* moves rearward in the axial direction of the drive shaft 3 and the rear end of the movable body 13*b* is arranged inward to the weight portion 49*a*. As a result, when the inclination angle of the swash plate 5 of the compressor is decreased, the weight portion 49*a* overlaps with approximately a half the rear end of the movable body 13*b*.

If the control valve 15*c* illustrated in FIG. 2 increases the amount of the refrigerant gas flowing in the supply passage 15*b*, the amount of the refrigerant gas flowing from the second discharge chamber 29*b* into the pressure regulation chamber 31 through the supply passage 15*b* is increased, in contrast to the case for decreasing the compressor displacement. The pressure in the control pressure chamber 13*c* is thus substantially equalized with the pressure in the second discharge chamber 29*b*. This moves the movable body 13*b* of the actuator 13 forward against the centrifugal force acting on the rotation members. This increases the volume of the control pressure chamber 13*c* and increases the inclination angle of the swash plate 5.

In other words, referring to FIG. 1, the swash plate 5 pivots about the operation axis M3 in the reverse direction. The opposite ends of the lug arm 49 pivot about the corresponding first and second pivot axes M1, M2 in the reverse directions correspondingly. The lug arm 49 thus separates from the flange 43*a* of the support member 43, thus increasing the stroke of each piston 9. As a result, the suction amount and displacement of the compressor per rotation cycle increase. The inclination angle of the swash plate 5 shown in FIG. 1 corresponds to the maximum inclination angle of the compressor.

The actuator 13 of the compressor is arranged in the swash plate chamber 33 in a manner rotatable integrally with the drive shaft 3. The control pressure chamber 13*c* is formed around the drive shaft 3 at the position between the rotation body 13*a* and the movable body 13*b* of the actuator 13. This prevents the length of the compressor in the direction of the rotation axis O of the actuator 13 from increasing, thus decreasing the axial length of the compressor as a whole.

Additionally, in the compressor, the rotation body 13*a* and the movable body 13*b* of the actuator 13 rotate integrally with the drive shaft 3. Thus, insufficient lubrication is unlikely to be caused about the movable body 13*b*. As a result, the actuator 13 of the compressor maintains improved sliding performance.

Particularly, the compressor ensures a clearance of a certain size between the wall of the first recess 21*c* and the movable body 13*b*. This prevents contact between the movable body 13*b* and the first cylinder block 21 both when the actuator 13 rotates and when the movable body 13*b* moves forward or rearward in the swash plate chamber 33. As a result, the compressor restricts wear about the actuator 13.

In the compressor, the movable body 13*b* faces to the link mechanism 7 including the lug arm 49 with the swash plate 5 arranged between the movable body 13*b* and the link mechanism 7. This increases the radial dimension of the control pressure chamber 13*c* in the actuator 13, thus facilitating urging of the swash plate 5 by the movable body 13*b*. As a result, the compressor changes the inclination angle of the swash plate 5 in a favorably manner, and performs displacement control in a favorable manner by selectively increasing and decreasing the stroke of each piston 9.

Accordingly, the compressor of the first embodiment is reduced in size and ensures enhanced durability and improved displacement control.

Additionally, in the compressor, the swash plate 5 supports the distal end of the lug arm 49 through the first pin 47*a* to allow the distal end of the lug arm 49 to pivot about the first pivot axis M1. The drive shaft 3 supports the basal end of the lug arm 49 through the second pin 47*b* to allow the basal end of the lug arm 49 to pivot about the second pivot axis M2. The movable body 13*b* supports the swash plate 5 through the third pin 47*c* to allow the swash plate 5 to pivot about the operation axis M3.

As a result, the simplified configuration of the link mechanism 7 reduces the size of the link mechanism 7 and, also, the size of the compressor. Further, the compressor facilitates pivot of the lug arm 49 and the movable body 13*b* supports the swash plate 5 to allow the swash plate 5 to pivot about the operation axis M3. The inclination angle of the swash plate 5 is thus changed in a favorable manner through the pivot of the lug arm 49.

The weight portion 49*a* of the lug arm 49 facilitates pivot of the lug arm 49 in such a direction as to decrease the inclination angle of the swash plate 5. This allows the compressor to perform the displacement control in a favorable manner by decreasing the stroke of each piston 9.

The ring plate 45 is attached to the swash plate 5 and the support member 43 is mounted around the drive shaft 3. This configuration ensures easy assembly between the swash plate 5 and the lug arm 49 and between the drive shaft 3 and the lug arm 49 in the compressor. Further, in the compressor, the swash plate 5 is easily arranged around the drive shaft 3 in a rotatable manner by passing the drive shaft 3 through the through hole 45*a* of the ring plate 45.

In the compressor, the lug arm 49 is capable of maintaining the inclination angle of the swash plate 5 at the minimum value. The movable body 13*b* is capable of maintaining the inclination angle of the swash plate 5 at the maximum value.

The inclination angle of the swash plate 5 is thus changed in a favorable manner in the range from the minimum value to the maximum value. This allows the compressor to perform the displacement control in a favorable manner.

The compressor includes the first and second thrust bearings 35*a*, 35*b*, which are arranged between the drive shaft 3 and the housing 1 to support the drive shaft 3 with respect to the housing 1 in a rotatable manner. The movable body 13*b* is mounted between the first and second thrust bearings 35*a*, 35*b*. The first and second thrust bearings 35*a*, 35*b* thus support the thrust force produced in the control pressure chamber 13*c* in the compressor.

In the compressor, the first and second suction chambers 27*a*, 27*b* communicate with the swash plate chamber 33 through the corresponding first and second suction passages 37*a*, 37*b*. The refrigerant gas drawn into the first and second suction chambers 27*a*, 27*b* is thus sent into the swash plate chamber 33. This allows the refrigerant gas to cool the drive shaft 3 and the actuator 13. Additionally, in the compressor, the movable body 13*b* is lubricated by the lubricant contained in the refrigerant gas when moving in the swash plate chamber 33. This allows the actuator 13 to maintain improved sliding performance and restricts wear about the actuator 13.

Since the swash plate chamber 33 has the inlet 330, the compressor of the first embodiment has an enhanced noise reducing effect, compared to a case in which the refrigerant gas from the evaporator flows into the first and second suction chambers 27*a*, 27*b* before reaching the swash plate chamber 33.

Particularly, in the control mechanism 15 of the compressor, the bleed passage 15*a* allows communication between the control pressure chamber 13*c* and the second suction chamber 27*b*. The supply passage 15*b* allows communication between the control pressure chamber 13*c* and the second discharge chamber 29*b*. The control valve 15*c* adjusts the opening degree of the supply passage 15*b*. As a result, the compressor quickly raises the pressure in the control pressure chamber 13*c* using the high pressure in the second discharge chamber 29*b*, thus increasing the compressor displacement rapidly.

The swash plate chamber 33 of the compressor is used as a path of the refrigerant gas to the first and second suction chambers 27*a*, 27*b*. This brings about a muffler effect. As a result, suction pulsation of the refrigerant gas is reduced to decrease the noise produced by the compressor.

Second Embodiment

Figure 4:
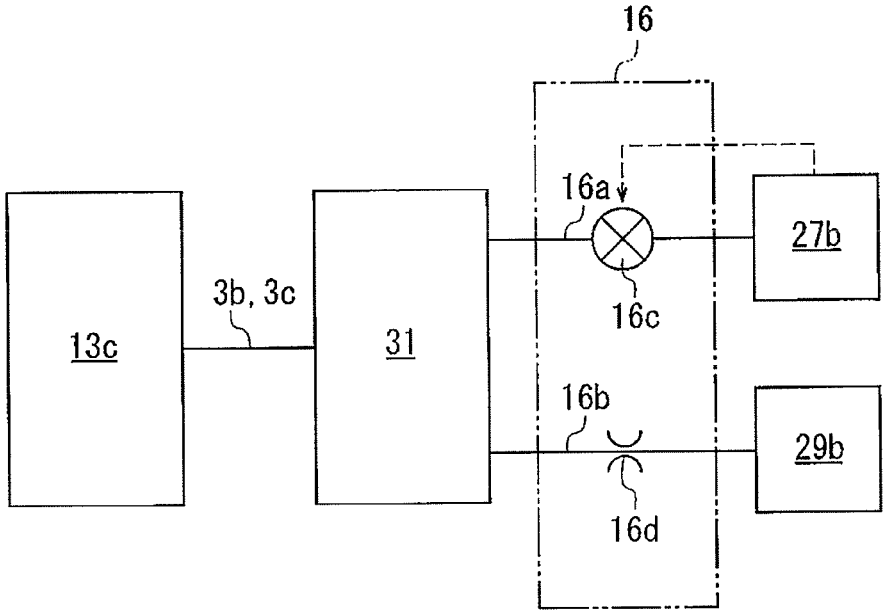
FIG. 4 is a schematic diagram showing a control mechanism of compressors according to second and fourth embodiments of the invention.

A compressor according to a second embodiment of the invention includes a control mechanism 16 illustrated in FIG. 4, instead of the control mechanism 15 of the compressor of the first embodiment. The control mechanism 16 includes a bleed passage 16*a* and a supply passage 16*b* each serving as a control passage, a control valve 16*c*, and an orifice 16*d*.

The bleed passage 16*a* is connected to the pressure regulation chamber 31 and the second suction chamber 27*b*. This configuration allows the bleed passage 16*a* to ensure communication between the control pressure chamber 13*c* and the second suction chamber 27*b*. The supply passage 16*b* is connected to the pressure regulation chamber 31 and the second discharge chamber 29*b*. The control pressure chamber 13*c* and the pressure regulation chamber 31 thus communicate with the second discharge chamber 29*b* through the supply passage 16*b*. The orifice 16*d* is formed in the supply passage 16*b* to restrict the amount of the refrigerant gas flowing in the supply passage 16*b*.

The control valve 16*c* is arranged in the bleed passage 16*a*. The control valve 16*c* is capable of adjusting the opening degree of the bleed passage 16*a* in correspondence with the pressure in the second suction chamber 27*b*. The control valve 16*c* thus adjusts the amount of the refrigerant flowing in the bleed passage 16*a*. As in the case of the aforementioned control valve 15*c*, a publicly available product may be employed as the control valve 16*c*. The axial passage 3*b* and the radial passage 3*c* each configure a section of the bleed passage 16*a* and a section of the supply passage 16*b*. The other components of the compressor of the second embodiment are configured identically with the corresponding components of the compressor of the first embodiment. Accordingly, these components are referred to using common reference numerals and detailed description thereof is omitted herein.

In the control mechanism 16 of the compressor, if the control valve 16*c* decreases the amount of the refrigerant gas flowing in the bleed passage 16*a*, the flow of refrigerant gas from the second discharge chamber 29*b* into the pressure regulation chamber 31 via the supply passage 16*b* and the orifice 16*d* is promoted. This substantially equalizes the pressure in the control pressure chamber 13*c* to the pressure in the second discharge chamber 29*b*. The movable body 13*b* of the actuator 13 thus moves forward against the centrifugal force acting on the rotation body. This increases the volume of the control pressure chamber 13*c*, thus increasing the inclination angle of the swash plate 5.

In the compressor of the second embodiment, the inclination angle of the swash plate 5 is increased to increase the stroke of each piston 9, thus raising the suction amount and displacement of the compressor per rotation cycle, as in the case of the compressor according to the first embodiment (see FIG. 1).

In contrast, if the control valve 16*c* illustrated in FIG. 4 increases the amount of the refrigerant gas flowing in the bleed passage 16*a*, refrigerant gas from the second discharge chamber 29*b* is less likely to flow into and be stored in the pressure regulation chamber 31 through the supply passage 16*b* and the orifice 16*d*. This substantially equalizes the pressure in the control pressure chamber 13*c* to the pressure in the second suction chamber 27*b*. The movable body 13*b* is thus moved rearward by the centrifugal force acting on the rotation body. This reduces the volume of the control pressure chamber 13*c*, thus decreasing the inclination angle of the swash plate 5.

As a result, by decreasing the inclination angle of the swash plate 5 and thus the stroke of each piston 9, the suction amount and displacement of the compressor per rotation cycle are lowered (see FIG. 3).

As has been described, the control mechanism 16 of the compressor of the second embodiment adjusts the opening degree of the bleed passage 16*a* by means of the control valve 16*c*. The compressor thus slowly lowers the pressure in the control pressure chamber 13*c* using the low pressure in the second suction chamber 27*a* to maintain desirable driving comfort of the vehicle. The other operations of the compressor of the second embodiment are the same as the corresponding operations of the compressor of the first embodiment.

Third Embodiment

Figure 5:
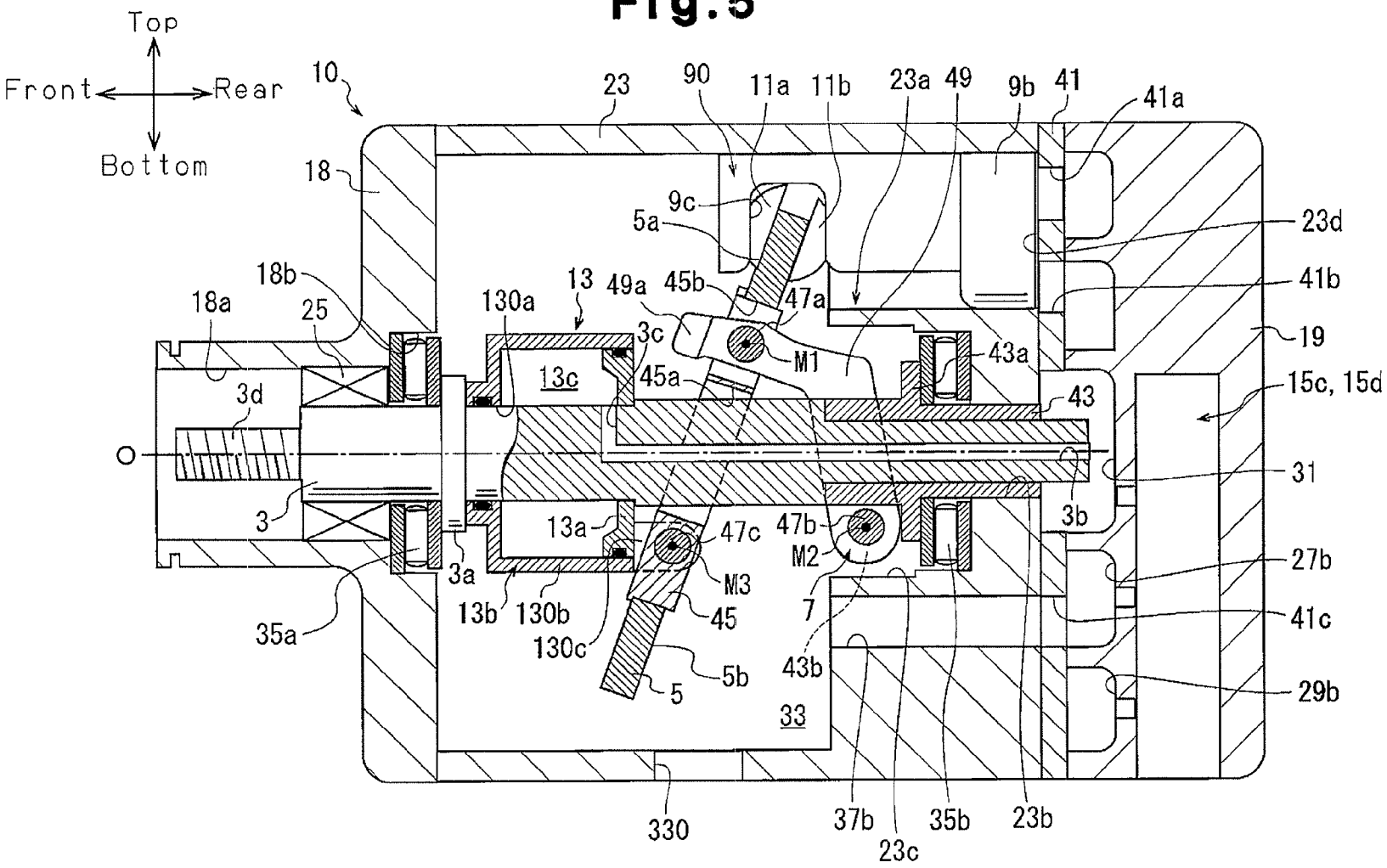
FIG. 5 is a cross-sectional view showing a compressor according to a third embodiment of the invention in a state corresponding to the maximum displacement.
Figure 6:
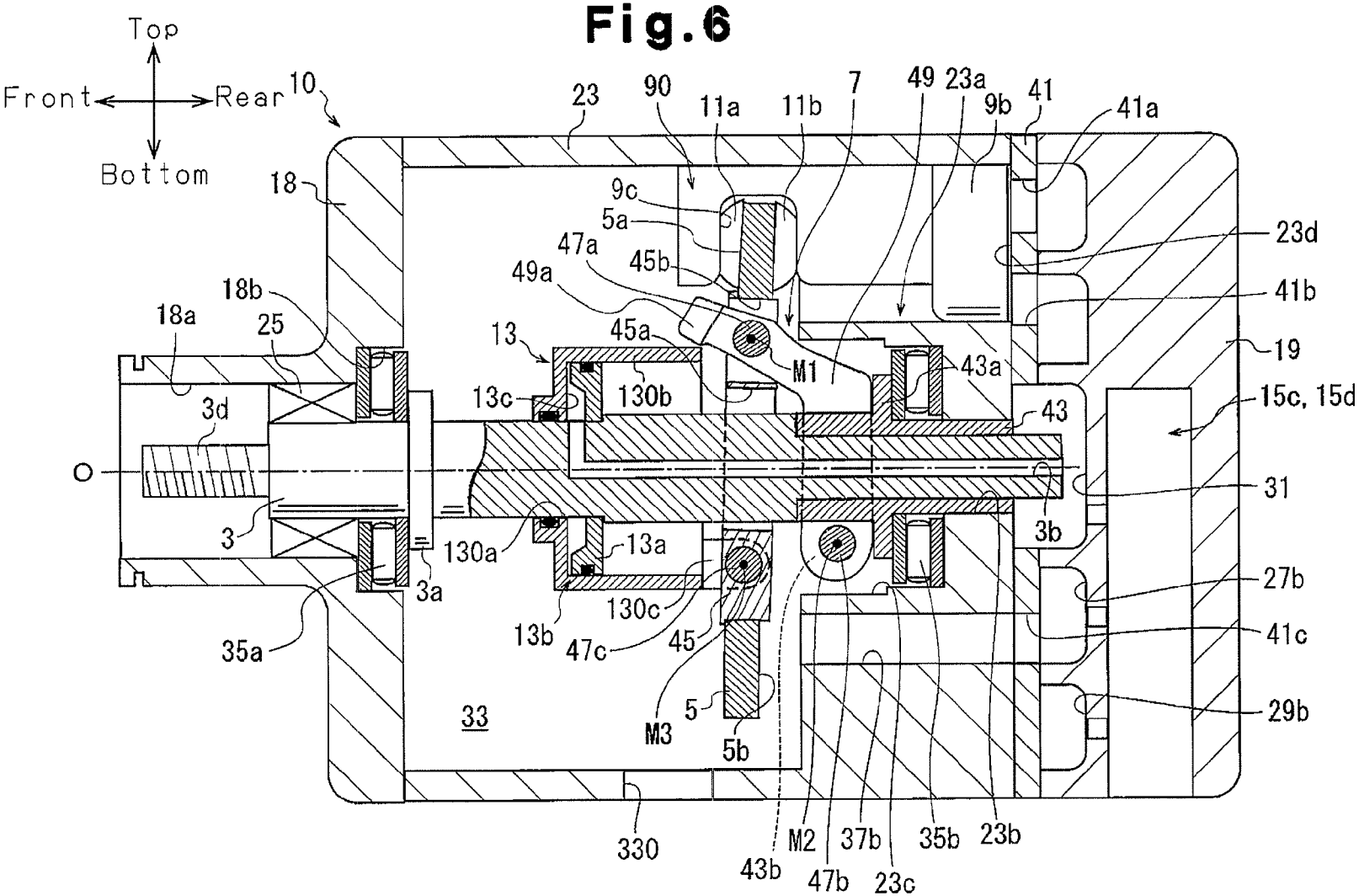
FIG. 6 is a cross-sectional view showing the compressor according to the third embodiment in a state corresponding to the minimum displacement.

As illustrated in FIGS. 5 and 6, a compressor according to a third embodiment of the invention includes a housing 10 and pistons 90, instead of the housing 1 and the pistons 9 of the compressor of the first embodiment.

The housing 10 has a front housing member 18, in addition to the rear housing member 19 and the second cylinder block 23, which are the same components as those of the first embodiment. The front housing member 18 has a boss 18*a* projecting forward and a recess 18*b*. The shaft sealing device 25 is mounted in the boss 18*a*. Unlike the front housing member 17 of the first embodiment, the front housing member 18 includes neither the first suction chamber 27*a* nor the first discharge chamber 29*a*.

In the compressor, the swash plate chamber 33 is formed by the front housing member 18 and the second cylinder block 23. The swash plate chamber 33 is arranged substantially in the middle of the housing 10 and communicates with the second suction chamber 27*b* via the second suction passage 37*b*. The first thrust bearing 35*a* is arranged in the recess 18*b* of the front housing member 18.

Unlike the pistons 9 of the first embodiment, each of the pistons 90 only has the piston head 9*b* at the rear end of the piston 90. The other components of each piston 90 and the other components of the compressor of the third embodiment are configured identically with the corresponding components of the first embodiment. For illustrative purposes, the second cylinder bore 23*a*, the second compression chamber 23*d*, the second suction chamber 27*b*, and the second discharge chamber 29*b* of the first embodiment will be referred to as the cylinder bore 23*a*, the compression chamber 23*d*, the suction chamber 27*b*, and the discharge chamber 29*b* in the following description about the third embodiment.

In the compressor of the third embodiment, the drive shaft 3 rotates to rotate the swash plate 5, thus reciprocating the pistons 90 in the corresponding cylinder bores 23*a*. The volume of each compression chamber 23*d* is thus varied in correspondence with the piston stroke.

Correspondingly, refrigerant gas is drawn from the evaporator into the swash plate chamber 33 through the inlet 330, reaches each compression chamber 23*d* via the suction chamber 27*b* for compression, and sent into the discharge chamber 29*b*. The refrigerant gas is then supplied from the discharge chamber 29*b* to the condenser through a non-illustrated outlet.

Like the compressor of the first embodiment, the compressor of the third embodiment is capable of executing displacement control by changing the inclination angle of the swash plate 5 to selectively increase and decrease the stroke of each piston 90.

With reference to FIG. 6, when the stroke of the piston 90 decreases, the suction amount and displacement of the compressor per rotation cycle decrease. The inclination angle of the swash plate 5 shown in FIG. 6 corresponds to the minimum inclination angle in the compressor.

As illustrated in FIG. 5, when the stroke of the piston 90 increases, the suction amount and displacement of the compressor per rotation cycle increase. The inclination angle of the swash plate 5 shown in FIG. 5 corresponds to the maximum inclination angle in the compressor.

The compressor of the third embodiment is formed without the first cylinder block 21 and thus has a simple configuration compared to the compressor of the first embodiment. As a result, the compressor of the third embodiment is further reduced in size. The other operations of the third embodiment are the same as those of the first embodiment.

Fourth Embodiment

A compressor according to a fourth embodiment of the present invention is the compressor according to the third embodiment employing the control mechanism 16 illustrated in FIG. 4. The compressor of the fourth embodiment operates in the same manners as the compressors of the second and third embodiments.

Although the present invention has been described referring to the first to fourth embodiments, the invention is not limited to the illustrated embodiments, but may be modified as necessary without departing from the scope of the invention.

For example, in the compressors of the first to fourth embodiments, refrigerant gas is sent into the first and second suction chambers 27*a*, 27*b* via the swash plate chamber 33. However, the refrigerant gas may be drawn into the first and second suction chambers 27*a*, 27*b* directly from the corresponding pipe through the inlet. In this case, the compressor should be configured to allow communication between the first and second suction chambers 27*a*, 27*b* and the swash plate chamber 33 so that the swash plate chamber 33 corresponds to a low pressure chamber.

The compressors of the first to fourth embodiments may be configured without the pressure regulation chamber 31.

A link mechanism employed by the compressors according to the present invention may be configured in various suitable manners as long as the link mechanism faces to the movable body with the swash plate arranged between the link mechanism and the swash plate as in the illustrated embodiments. Particularly, the link mechanism may include a lug arm. The swash plate may support the distal end of the lug arm to allow the distal end of the lug arm to pivot about the first pivot axis, which is perpendicular to the rotation axis. The drive shaft may support the basal end of the lug arm to allow the basal end of the lug arm to pivot about the second pivot axis, which is parallel to the first pivot axis. It is preferable that the movable body support the swash plate to allow the swash plate to pivot about the operation axis, which is parallel to the first and second pivot axes.

In this case, by simplifying the link mechanism, the link mechanism is reduced in size and thus the compressor becomes compact. This also facilitates pivot of the lug arm. The pivot of the lug arm facilitates desirable change of the inclination angle of the swash plate.

The lug arm may include a weight portion extending at the opposite side to the second pivot axis with respect to the first pivot axis. It is preferable that the weight portion rotates about the rotation axis and thus applies force to the swash plate in such a direction that the inclination angle decreases.

This configuration facilitates pivot of the lug arm in such a direction that the inclination angle of the swash plate decreases. As a result, the compressor is allowed to control the displacement in a favorable manner by decreasing the piston stroke.

The swash plate may support the distal end of the lug arm to allow the distal end of the lug arm to pivot about the first pivot axis. Also, the swash plate may include a first member capable of pivoting about the operation axis. It is preferable that the first member has an annular shape with a through hole through which the drive shaft is passed.

The first member of this configuration facilitates assembly of the swash plate with the lug arm. The drive shaft is passed through the through hole of the first member to facilitate assembly of the swash plate with the drive shaft in a rotatable manner.

It is preferable that a second member be fixed to the drive shaft to support the basal end of the lug arm to allow the basal end of the lug arm to pivot about the second pivot axis. In this case, the second member facilitates assembly of the drive shaft with the lug arm.

It is preferable that one of the first member and the second member be capable of maintaining the inclination angle at the minimum value. It is also preferable that one of the rotation body and the movable body be capable of maintaining the inclination angle at the maximum value (Claim 7).

In these configurations, the swash plate is allowed to change its inclination angle in a favorable manner in the range from the minimum inclination angle to the maximum inclination angle. As a result, the compressor is capable of controlling the displacement in a favorable manner.

The first pivot axis may be defined by a first pin arranged between the first member and the lug arm. The second pivot axis may be defined by a second pin mounted between the second arm and the lug arm. It is preferable that the operation axis be defined by a third pin arranged between the first member and the movable body.

In this configuration, the first pin facilitates support of the distal end of the lug arm by the first member such that the distal end of the lug arm is allowed to pivot. The second pin facilitates support of the basal end of the lug arm by the second member such that the basal end of the lug arm is allowed to pivot. The third pin facilitates support of the pivot plate by the movable body such that the pivot plate is allowed to pivot.

A pair of thrust bearings may be arranged between the drive shaft and the housing to support the drive shaft with respect to the housing in a rotatable manner. It is preferable that the movable body be mounted between the thrust bearings. In this configuration, the thrust force produced in the control pressure chamber is borne by the thrust bearings.

One of the suction chamber and the swash plate chamber may be a low pressure chamber. It is preferable that the control mechanism include a control passage through which the control pressure chamber communicates with the low pressure chamber and/or the discharge chamber and a control valve capable of adjusting the opening degree of the control passage.

This configuration allows the control mechanism of the compressor to control the actuator using the pressure difference between the control pressure chamber and the low pressure chamber and the pressure difference between the control pressure chamber and the discharge chamber.

The control passage may include a bleed passage through which the control pressure chamber communicates with the low pressure chamber and a supply passage through which the control pressure chamber communicates with the discharge chamber. It is preferable that the control valve adjust the opening degree of the supply passage. In this case, the high pressure in the discharge chamber rapidly increases the pressure in the control pressure chamber, thus quickly decreasing the compressor displacement.

The control passage may include a bleed passage through which the control pressure chamber communicates with the low pressure chamber and a supply passage through which the control pressure chamber communicates with the discharge chamber. It is preferable that the control valve adjusts the opening degree of the bleed passage. In this case, the low pressure in the low pressure chamber slowly lowers the pressure in the control pressure chamber, thus maintaining desirable driving comfort.

It is preferable that the suction chamber communicates with the swash plate chamber through the suction passage. In this case, the refrigerant gas drawn into the suction chamber flows also into the swash plate chamber. This allows the refrigerant gas to cool the drive shaft and the actuator. Also, the movable body is lubricated by the lubricant contained in the refrigerant gas when moving in the swash plate chamber. This allows the actuator to maintain comparatively high sliding performance and thus restricts wear about the actuator.

It is preferable that the swash plate chamber have an inlet connected to the evaporator. In this case, the noise decreasing effect is improved compared to a case in which the refrigerant gas from the evaporator flows into the swash plate chamber after passing through the suction chamber.

The invention claimed is:

1. A swash plate type variable displacement compressor comprising:

a housing in which a suction chamber, a discharge chamber, a swash plate chamber, and a cylinder bore are formed;

a drive shaft rotationally supported by the housing;

a swash plate rotatable in the swash plate chamber by rotation of the drive shaft;

a link mechanism arranged between the drive shaft and the swash plate, the link mechanism allowing change of an inclination angle of the swash plate with respect to a line perpendicular to the rotation axis of the drive shaft;

a piston reciprocally received in the cylinder bore;

a conversion mechanism that causes the piston to reciprocate in the cylinder bore by a stroke corresponding to the inclination angle of the swash plate through rotation of the swash plate;

an actuator capable of changing the inclination angle of the swash plate; and a control mechanism that controls the actuator, wherein the actuator is arranged in the swash plate chamber and rotates integrally with the drive shaft, the actuator includes a rotation body fixed to the drive shaft, a movable body that is connected to the swash plate and movable relative to the rotation body in the direction of the rotation axis of the drive shaft, and a control pressure chamber that is defined by the rotation body and the movable body and moves the movable body using pressure in the control pressure chamber, the control mechanism changes the pressure in the control pressure chamber to move the movable body, and the movable body faces the link mechanism with the swash plate arranged between the movable body and the link mechanism.

2. The compressor according to claim 1, wherein the link mechanism has a lug arm, the lug arm has a distal end supported by the swash plate to be allowed to pivot about a first pivot axis perpendicular to the rotation axis and a basal end supported by the drive shaft to be allowed to pivot about a second pivot axis parallel to the first pivot axis, and the swash plate is supported by the movable body so that the swash plate is allowed to pivot about an operation axis parallel to the first pivot axis and the second pivot axis.

3. The compressor according to claim 2, wherein the lug arm includes a weight portion extending at the opposite side to the second pivot axis with respect to the first pivot axis, and the weight portion rotates about the rotation axis to apply force to the swash plate to decrease the inclination angle.

4. The compressor according to claim 2, wherein the swash plate has a first member that supports the distal end of the lug arm to allow the distal end of the lug arm to pivot about the first pivot axis and is capable of pivoting about the operation axis, and the first member has a through hole through which the drive shaft is passed.

5. The compressor according to claim 4, wherein a second member is fixed to the drive shaft, and the second member supports the basal end of the lug arm to allow the basal end of the lug arm to pivot about the second pivot axis.

6. The compressor according to claim 5, wherein one of the lug arm, the first member, and the second member is capable of maintaining the inclination angle of the swash plate at a minimum value.

7. The compressor according to claim 1, wherein one of the rotation body and the movable body is capable of maintaining the inclination angle of the swash plate at a maximum value.

8. The compressor according to claim 4, wherein the first pivot axis is defined by a first pin arranged between the first member and the lug arm, the second pivot axis is defined by a second pin arranged between the second member and the lug arm, and the operation axis is defined by a third pin arranged between the first member and the movable body.

9. The compressor according to claim 1, wherein a pair of thrust bearings are arranged between the drive shaft and the housing to support the drive shaft in a rotatable manner with respect to the housing, and the movable body is arranged between the thrust bearings.

10. The compressor according to claim 1, wherein one of the suction chamber and the swash plate chamber is a low pressure chamber, and the control mechanism has a control passage, through which the control pressure chamber communicates with at least one of the low pressure chamber and the discharge chamber, and a control valve capable of adjusting an opening degree of the control passage.

11. The compressor according to claim 10, wherein the control passage is configured by a bleed passage, through which the control pressure chamber communicates with the low pressure chamber, and a supply passage, through which the control pressure chamber communicates with the discharge chamber, and the control valve adjusts an opening degree of the supply passage.

12. The compressor according to claim 10, wherein the control passage is configured by a bleed passage, through which the control pressure chamber communicates with the low pressure chamber, and a supply passage, through which the control pressure chamber communicates with the discharge chamber, and the control valve adjusts an opening degree of the bleed passage.

13. The compressor according to claim 1, wherein the suction chamber and the swash plate chamber communicate with each other through a suction passage.

14. The compressor according to claim 13, wherein the swash plate chamber has an inlet connected to an evaporator.

* * * * *